United States Patent [19]

Yunan

[11] Patent Number: 4,796,533

[45] Date of Patent: Jan. 10, 1989

[54] PRIMER ASSEMBLY

[75] Inventor: Malak E. Yunan, Morris County, Boonton Township, N.J.

[73] Assignee: ETI Explosives Technologies International Inc., Wilmington, Del.

[21] Appl. No.: 46,559

[22] Filed: May 6, 1987

Related U.S. Application Data

[60] Division of Ser. No. 714,505, Mar. 25, 1985, Pat. No. 4,718,345, which is a continuation-in-part of Ser. No. 616,138, Jun. 1, 1984, abandoned.

[51] Int. Cl.[4] ..... C06C 5/04; F42B 3/10

[52] U.S. Cl. ..... 102/322; 102/275.3; 102/275.12

[58] Field of Search ..... 102/304, 312–315, 102/318, 320, 322, 331, 275.3, 275.4, 275.5, 275.12

[56] References Cited

U.S. PATENT DOCUMENTS

| | | | |
|---|---|---|---|
| Re. 30,621 | 5/1981 | Calder et al. | 102/275.3 X |
| 3,709,149 | 1/1973 | Driscoll | 102/312 |
| 4,060,033 | 11/1977 | Postupack et al. | 102/318 |
| 4,060,034 | 11/1977 | Bowman et al. | 102/318 X |
| 4,133,247 | 1/1979 | Calder et al. | 102/304 X |
| 4,165,691 | 8/1979 | Bowman et al. | 102/322 |
| 4,178,852 | 12/1981 | Smith et al. | 102/322 |
| 4,295,424 | 10/1981 | Smith et al. | 102/320 X |
| 4,383,484 | 5/1983 | Morrey | 102/313 X |
| 4,425,849 | 1/1984 | Jorgenson | 102/322 X |
| 4,527,482 | 7/1985 | Hynes | 102/331 |

OTHER PUBLICATIONS

Austin Technical Data Bulletin ADP 1183: *Austin Delay Boosters.*

Atlas Data Sheet 701: *Deckmaster/Primemaster.*

*Primary Examiner*—David H. Brown

*Attorney, Agent, or Firm*—Diamond C. Ascani

[57] ABSTRACT

A primer assembly for use in the non-electic initiation of cap-insensitive explosives, especially of deck-loaded explosive charges by means of a single downline of low-energy detonating cord (LEDC), includes a percussion-actuated detonator seated in a cavity in a high-energy primer, and an explosive coupler in which a coupling explosive charge, housed in a plastic connecting block, is in initiating proximity to the detonator's percussion-sensitive ignition charge and sufficiently close to a cord-receiving perforation or conduit in or adjacent the primer as to be initiatable by the detonation of LEDC threaded therethrough. A preferred connecting block has means for engaging the detonator, and means for attaching the block to the primer. Preferably the explosive coupler is seated within a block-like cavity in the primer.

34 Claims, 3 Drawing Sheets

PRIMER ASSEMBLY

CROSS-REFERENCE TO RELATED APPLICATION

This application is a divisional application of Ser. No. 714,505 filed Mar. 25, 1985, now U.S. Pat. No. 4,718,345, which is a continuation-in-part of application Ser. No. 616,138, filed June 1, 1984, now abandoned.

BACKGROUND OF THE INVENTION

1. Field of the Invention

The present invention relates to means for explosively coupling low-energy detonating cord to a percussion-actuated detonator in an explosive primer. The invention relates also to a primer assembly containing such means for use in the non-electric initiation of cap-insensitive explosives, and more particularly for use in the delayed initiation of deck-loaded explosive charges by means of a single detonating cord downline.

2. Description of the Prior Art

Blasting operations in which a cap-insensitive explosive is to be initiated non-electrically at a delay interval provided in the borehole itself usually require the use of a cap-sensitive high-energy primer (sometimes referred to as a "booster"), a non-electric delay detonator, and a means of operatively connecting the detonator to the primer and to a detonating cord downline. In the deck-loading technique of blasting with such explosives, often used where the elimination of excessive vibration is an important consideration, the cap-insensitive explosive is loaded into the borehole in decks separated from one another by a layer of inert stemming material. When this technique is used, each deck requires a primer (e.g., a primer operatively connected to a detonator), in which the detonator is operatively connected to a downline cord. Systems in which the primers in all of the decks are connected by a single downline are preferred (over those in which an individual downline is required for each primer) because the downline system is less complex and the borehole loading operation and hookup easier.

U.S. Pat. No. 3,709,149, issued Jan. 9, 1973, to H. E. Driscoll, shows a delay booster assembly in which a percussion-actuated delay detonator is seated in a well formed in a cylindrical booster in a direction perpendicular to the longitudinal axis of the cylinder. A detonating cord extends lengthwise of the booster, i.e., perpendicular to the detonator, passing through a loop member at the detonator's actuation end and a cord tunnel member strapped to the booster shell. The detonator is actuated by percussion initiation of an impact-sensitive primer charge caused by the detonation of the cord. In one embodiment, a single downline cord extends through the loop members on the detonators in multiple booster assemblies. One of the disadvantages of the Driscoll booster assembly is that the perpendicular arrangement of the detonator demands a large-diameter booster to accommodate the length of delay detonators commonly used.

In the delay booster assembly described in U.S. Pat. Nos. 4,060,033 and 4,060,034, issued Nov. 29, 1977, to C. Postupack et al. and A. F. Bowman et al., respectively, the non-electric delay detonator is positioned in a cap well which is parallel to the longitudinal axis of the cylindrical booster. Multiple boosters slide on a common 5–6 g/m downline detonating cord threaded through a detonating cord tunnel, affixed to the side of the booster or enclosed inside the booster shell. The cord tunnel is surrounded by a shock-absorbing material. In addition to the downline cord, this system requires the use of a second cord, e.g., a length of low-energy detonating cord (LEDC), with each booster to act as a signal carrier, which transmits a signal from a shock-sensitive sensor to a delay charge in the detonator. The shock-sensitive sensor, attached to one end of the LEDC, is an explosive-containing metal shell positioned with its bottom end adjacent the downline cord. The other end of the LEDC is crimped into the open end of the detonator shell. Thus, this detonator is not a self-contained separate unit adapted for field assembly, but it must be shipped and handled in a delay insert assembly with the shock-sensitive sensor and signal carrier cord, which is housed, for example, in an L-shaped plug that seals the detonator shell.

According to U.S. Pat. No. 4,295,424, issued Oct. 20, 1981, to D. H. Smith et al., the delay detonator in a unit that also includes an initiating means (small primer charge) and a passive radiator (flexible L-shaped hollow tube) should be widely separated from the downline cord, and the passive radiator provides for this separation. The detonator is positioned near the edge of the booster diametrically opposed to the downline cord conduit on the exterior of the booster container.

In a delay booster assembly shown in Austin Technical Data Bulletin ADP 1183, Austin Powder Company, Cleveland, Ohio, entitled, *Austin Delay Boosters,* the booster container has an external downline channel and an essentially axial delay channel. An elongated delay element, in the form of a delay detonator having the end of a pigtail cord crimped into its shell is used. The detonator is seated in the delay channel and the pigtail inserted into the downline channel. The downline threads through the downline channel, and abuts the pigtail therein, thereby relaying the initiation impulse from the side output of the downline to the detonator.

SUMMARY OF THE INVENTION

The present invention provides a primer assembly adapted to be threaded onto a low-energy detonating cord (LEDC) and comprising:

(a) a substantially cylindrical explosive primer, e.g., a cast explosive, optionally having a wrap of paper, cardboard, or the like, with or without end-capping, or held in a plastic container, said primer (1) having a detonator-receiving cavity therein substantially parallel to its longitudinal axis, and (2) constituting, or being associated with, an apertured means of threading LEDC at a location separated from, and on an axis substantially parallel to, the cavity, e.g., having a cord-receiving perforation therethrough or having a wrapper or container provided with an external cord-receiving tubular conduit or multiple aligned external conduits or ferrules;

(b) seated within the detonator-receiving cavity, a detonator having a percussion-sensitive ignition charge therein at its actuation end; and (c) an explosive coupler comprising a plastic connecting block housing a coupling charge of shock-sensitive detonating explosive, e.g., lead azide powder, in linear array in a bore therein; the explosive coupler being attached to the primer in a manner such that the explosive charge in the bore is (1) perpendicular to the detonator and in initiating proximity to the detonator's percussion-sensitive ignition charge, and (2) perpendicular to the aperture of the LEDC-threading means, e.g., the cord-receiving perforation or conduit, and in close enough proximity thereto as to be initiatable by the detonation of LEDC threaded through the aperture; the distances and inert material between explosive charges, and the energy output and degree of sensitivity of the charges, in the cord-threaded primer assembly being such that the explosive primer is adapted to be initiated by the detonator as a result of the transmission of an initiating impulse from the cord to the detonator via the explosive coupler.

Means is provided in the assembly, preferably on the plastic connecting block, for holding the detonator in the detonator-receiving cavity at a location required to place its percussion-sensitive ignition charge in the required proximity to the attached explosive coupler, and for directing LEDC threaded through the threading aperture of the primer so that it passes in the required proximity to the attached explosive coupler.

A preferred primer assembly of the invention contains an explosive coupler, also provided by the invention, for operatively joining a low-energy detonating cord (LEDC) to a percussion-actuated detonator comprising (a) a plastic connecting block housing a coupling charge of shock-sensitive detonating explosive, e.g., lead azide powder, in linear array in a bore therein, the bore being (1) completely spanned by a thin closure membrane so as to adapt it to retain the linear coupling charge, or (2) at least partially closed by stop means adapted to position a housing shell for the coupling charge at a desired location; and (b) detonator-engaging means on the block adapted to engage a detonator having a percussion-sensitive ignition charge therein at its actuation end in a manner such that the coupling charge is perpendicular to the detonator and held in initiating proximity to the detonator's percussion-sensitive ignition charge.

In a more-preferred coupler, the connecting block is provided with a cord-receiving aperture lying on a longitudinal axis which is perpendicular to the longitudinal axis of the bore, and parallel to the detonator which the block is adapted to engage, the aperture in the block (a) being adapted to be coaxial with the cord-threading aperture of the explosive primer to which the coupler is to be attached, and (b) being adjacent the block's bore closure or stop means so that LEDC threaded through the aperture is directed to pass in close enough proximity to the coupling charge in the bore as to initiate it.

A preferred connecting block, also provided by the invention, for use in the explosive coupler of the invention comprises a substantially L-shaped plastic member having first and second perpendicular arms of substantially tubular configuration, the first arm having an open passageway adapted to have LEDC threaded therethrough, and the second arm having a bore adapted to receive and linearly array the coupling charge, preferably held in a closed shell, and to retain the charge adjacent the passageway in the first arm through which the LEDC is to be threaded. The connecting block's second arm is adapted to engage a percussion-actuated detonator so as to (a) position it substantially perpendicular to the bore in the second arm and substantially parallel to the first arm, and (b) hold the detonator's percussion-sensitive ignition charge in initiatable proximity with respect to the coupling charge adapted to be linearly arrayed in the bore therein.

The term "initiating proximity", as used herein to describe the relative positioning of the coupling explosive charge and the percussion-sensitive ignition charge in the detonator denotes a proximity which, for a given explosive coupler, permits the detonation of the coupling charge therein to actuate the detonator by percussion.

BRIEF DESCRIPTION OF THE DRAWING

In the accompanying drawing, which illustrates specific embodiments of the primer assembly, primer, explosive coupler, coupler-detonator assembly, and connecting block of the invention.

DETAILED DESCRIPTION

Figure 1:
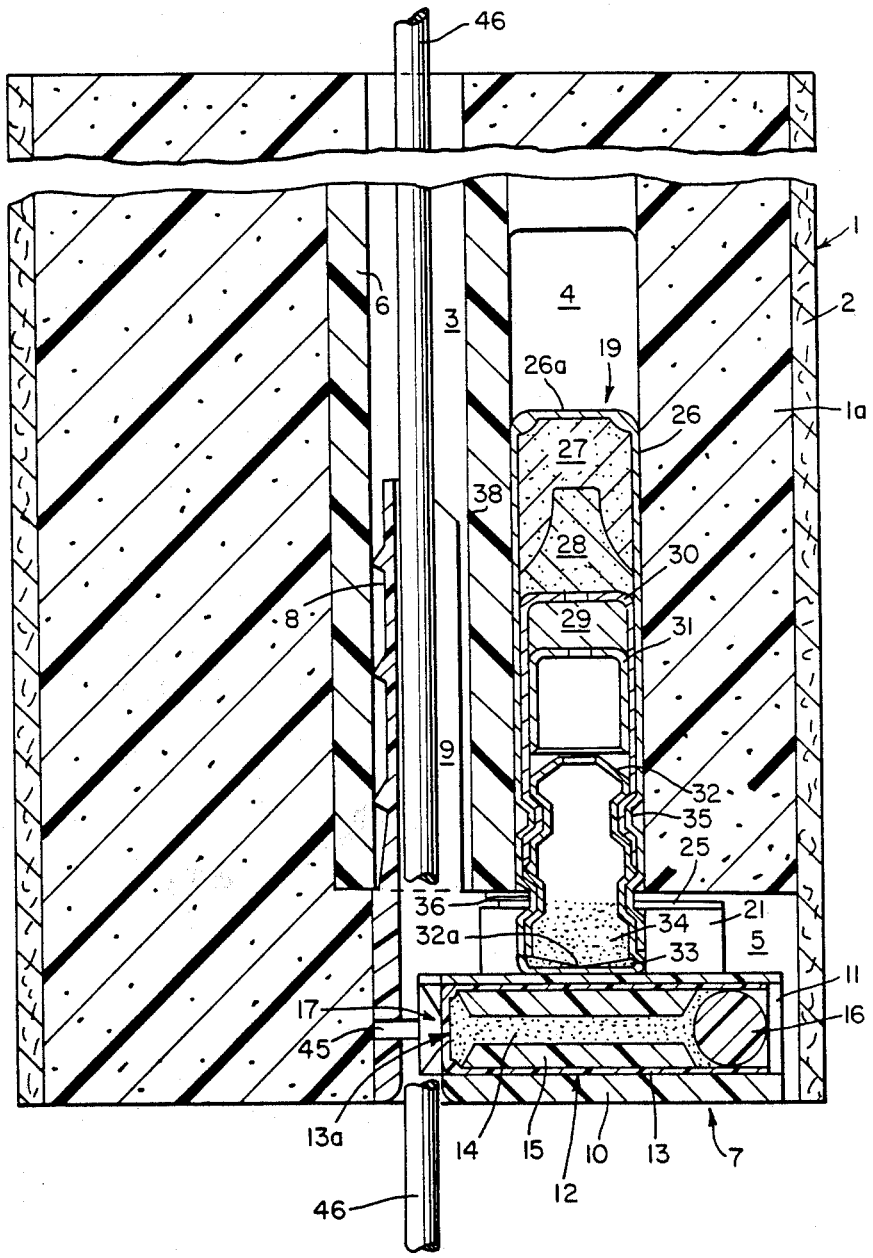
FIG. 1 is a cross-sectional view of a preferred primer assembly of the invention threaded onto a length of low-energy detonating cord.

The primer assembly of the invention contains (1) an explosive primer, i.e., a substantially cylindrical mass of explosive, usually a cast explosive, generally lightly wrapped with paper or cardboard, optionally end-capped, or held in a plastic container; (2) a detonator seated within a cavity in the primer; and (3) an explosive coupler comprising an explosive-containing connecting block for explosively coupling the detonator to LEDC wich is to be threaded through a perforation in the primer, or through a conduit external to the primer. A preferred primer assembly is shown in FIG. 1. The connecting block of the FIG. 1 assembly is depicted as a separate element in FIGS. 2 and 3. The detonator-receiving cavity and cord-receiving perforation in the primer may be paper-lined.

In the primer assembly shown in FIG. 1, 1 is a substantially cylindrical explosive primer, typically formed from a cast explosive 1a of the kind commonly used in high-energy primers, e.g., the primer explosive described in U.S. Pat. No. 4,343,663. Primer 1 has a light peripheral wrap 2. e.g., a cardboard tube into which explosive 1a has been cast. Primer 1 has an aperture or perforation 3 therethrough running parallel to, and coincident with, its longitudinal cylindrical axis. By virtue of perforation 3, primer 1 constitutes an apertured means of threading LEDC.

Primer 1 also is provided with two cavities: a closed-end detonator-receiving cavity 4 separated from, and parallel to, perforation 3; and cavity 5, adjacent perforation 3 and cavity 4, and so conformed as to receive, together with perforation 3, a connecting block in an explosive coupler for explosively coupling a length of LEDC 46, threaded through perforation 3, to a detonator seated in cavity 4. Around perforation 3 and contiguous to cavities 4 and 5 is a tubular mass 6 of a cap-sensitive rubber-like extruded mixture of PETN and an elastomeric binder. Mass 6 constitutes a small booster, which may be used advantageously with the primer explosive described in the above-mentioned U.S. Pat. No. 4,343,663.

Figure 2:
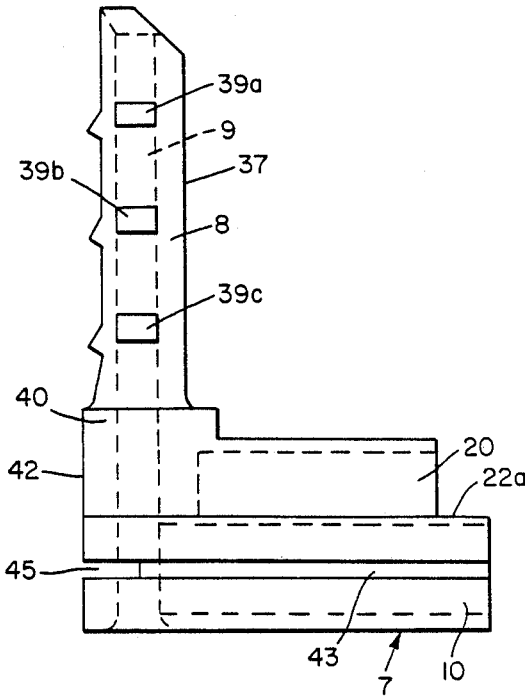
FIG. 2 is a side elevation of the connecting block shown in FIG. 1 when empty.

The aforementioned connecting block, denoted generally by the numeral 7, is a largely rigid plastic member having a substantially L-shaped configuration (see FIG. 2). One arm of the L, 8, of substantially tubular configuration, is inserted into perforation 3 in primer 1 (FIG. 1). Arm 8 has an open passageway 9 which communicates with perforation 3, thus allowing LEDC to be threaded through perforation 3 when arm 8 is in place therein. The wall of arm 8 is split longitudinally to form separated edges 37 an 38, and is provided with three rows of circumferential, appropriately angled spikes 39*a*, 39*b*, and 39*c*, which act as gripping means that allow arm or stem 8 to be inserted into perforation 3 and to grip into the surrounding wall of the rubber-like explosive tube 6. thus hindering the retraction of block 7 from primer 1 due to forces encountered when the assembled primer is lowered into a hole. When LEDC, threaded through perforation 3, detonates, spikes 39*a,b,c* are driven into the wall of explosive tube 6 to hinder the ejection of block 7 from primer 1 as a result of the detonation of the LEDC or explosive coupling charge 14. This block retention is important because the block couples the LEDC explosively to a delay detonator 19 via explosive coupling element 12. Block and detonator retention also may be aided by the split in arm 8, which faces detonator 19 and allows explosive energy to be directed preferentially toward the portion of tube 6 between the split and detonator 19. The other arm, 10, of block 7, perpendicular to block-attaching arm 8, is the part of the explosive coupler which houses the coupling charge. Arm 10 has a tubular bore 11 in which explosive coupling element 12 is seated. When arm 8 of connecting block 7 is in position in perforation 3, arm 10 and coupling element 12 are perpendicular to detonator-receiving cavity 4 and to percussion-actuated detonator 19 seated therein. Detonator 19 is engaged by arm 10, as will be explained below.

Explosive coupling element 12 consists of shell 13, e.g., made of metal, integrally closed at one end 13*a* and containing a coupling charge 14 of shock-sensitive detonating explosive, e.g., lead azide powder. Shell 13 contains a plastic lining tube 15 ending short of integrally closed end 13*a* and bevelled at its edges to facilitate the flow of explosive powder during the loading of the shell. The open end of shell 13 is sealed with a spherical plastic plug 16. The bore of tube 15, and the space between (a) the end of tube 15 and shell end 13*a* and (b) the other end of tube 15 and plug 16, contain explosive powder 14.

As is shown in FIG. 1, explosive coupling element 12 is seated in bore 11 of block arm 10. As can be seen from FIG. 3, bore 11 is partially closed by a pair of stop means 17, comprised of flat and tapered areas at the end of bore 11. Stop means or bore closure 17 is located adjacent passageway 9. An opening or slot 49 is formed by stop means 17 and passageway 9, owing to slot 45 in the end wall of block 7 (see below). Thus, when coupler shell 13 is pushed into bore 11 and comes to rest against stop means 17, its coined-bottom end 13*a* faces passageway 9 through the opening 49 in stop means 17.

In order to complete the explosive coupling of the LEDC to detonator 19, arm 10 of connecting block 7 is provided with a pair of opposing extension members 20 and 21, which, together with the portion 22 of the surface of arm 10 therebetween, form a substantially U-shaped channel 23 for slidably engaging detonator 19. Extension members 20 and 21 lie in planes that are parallel to the plane in which the longitudinal axes of both arms 8 and 10 lie, and the edges of members 20 and 21 are turned inward toward one another to form lips 24 and 25, respectively.

Extension members 20 and 21 on arm 10 extend past arm 8 and form a pair of opposing walls 40 and 41 which, together with end surface 42, form a collar around arm 8. The portions of extension members 20 and 21 which form walls 40 and 41 are wider than the remaining portions. An additional feature of block 7 is a pair of slits or grooves 43 and 44 along its side walls and a slot 45 on its adjoining end wall.

Detonator 19 is a percussion-actuated detonator, e.g., of the type described in U.S. Pat. No. 4,429,632, the disclosure of which is incorporated herein by reference. Briefly, it comprises a tubular metal detonator shell 26 integrally closed at one end 26*a* and containing, in sequence from end 26*a*, a base charge 27 of a detonating explosive composition, a priming charge 28 of a heat-sensitive detonating explosive composition, and a delay charge 29 of an exothermic-burning composition. Delay charge 29 is pressed into plastic capsule 30, and metal capsule 31 is seated within capsule 30 against delay charge 29. Capsules 30 and 31 both have one open extremity and a closure at the other extremity provided with an axial orifice therethrough, i.e., the closures seated against charges 28 and 29, respectively.

Detonator shell 26 is closed by an ignition assembly comprising primer shell 32, in this case a rim-fired empty primed rifle cartridge casing. Shell 32 has an open end and an integrally closed end 32*a* which peripherally supports on its inner surface a percussion-sensitive primer charge 33 for rim-firing. Flame-sensitive ignition charge 34, which has been loosely loaded into metal capsule 31, finds itself adjacent percussion-sensitive primer charge 33 when the detonator is turned upside down for insertion into cavity 4. Shell 32 is held in shell 26 by circumferential crimps 35 and 36.

When detonator 19 is to be engaged by channel 23, the detonator, with its percussion primer end 32*a* resting against the portion 22*a* of surface 22, is slid into channel 23 at the adjoining free end surfaces of extension members 20 and 21, lips 24 and 25 gripping circumferential crimp 36. Detonator 19 is slidable along channel 23, and this permits the connecting block to be used with primers having different spacings between cavity 4 and the LEDC-receiving perforation or conduit. Slight mobility of the detonator in the direction of its longitudinal axis owing to a difference between the thickness of lips 24 and 25 and the width of crimp 36 is permissible and may even be beneficial in promoting detonator retention in the primer upon detonation of coupling charge 14, as will be described hereinafter.

Once coupler 12 is seated in bore 11, and detonator 19 is engaged in channel 23, connecting block 7 is ready to be positioned in primer 1. While the detonator is held at its required distance from arm 8, the latter is pushed up into perforation 3 and the detonator enters cavity 4. The block is pushed into cavity 5 until the leading edges of the collar formed from walls 40 and 41 and surface 42 abut the end of tube 6 thereby placing block 7 essentially completely within the confines of cavity 5. Because extension members 20 and 21 are wider in the collar portion than in the portion which engages detonator 19, there is a small spacing between lips 24 and 25 and the edge of cavity 5 abutted by the collar. This spacing, grooves 43 and 44, and slot 45 are provided to promote detonator retention in primer 1 upon detonation of coupling charge 14.

When LEDC is threaded through perforation 3 and passageway 9 therein adjacent the bottom of explosive-containing shell 13, and the LEDC detonates, the detonation is picked up by explosive charge 14. Block 7 is so designed that detonator 19 remains in place in cavity 4 as required and is not caused to be ejected therefrom by the detonation of charge 14. Several features allow the detonator to be released from block 7, and remain in place, when charge 14 detonates: the spacing between detonator channel 23 and the edge of the primer cavity; the previously mentioned slight mobility of the detonator in a direction parallel to perforation 3; and the thinness and somewhat yielding nature of lips 24 and 25 should the block move out of the primer on detonation of charge 14. Also, block 7 may aplit along grooves 43 and 44, and slot 45 on detonation of the coupling charge, also preventing detonator ejection.

Figure 4:
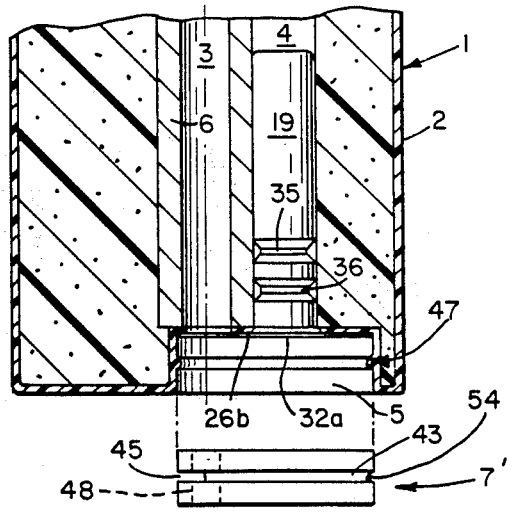
FIG. 4 is a partially cross-sectional, exploded view of a portion of a delay primer assembly of the invention wherein the connecting block, the means of attaching the block to the primer, and the means of positioning the block with respect to the detonator are different from those in the assembly shown in FIG. 1.

In the primer assembly depicted in FIG. 4, primer 1 has a jacket or sheath 2 of plastic, which caps the end of the primer and follows the outline of cavity 5. Jacket 2 has two access holes in it in the portion thereof lining cavity 5: one adjacent perforation 3 and one adjacent cavity 4. The cavity portion of jacket 2 also has projecting ribs 47, which constitute a part of a tongue and groove means of attaching the connecting block 7 of the explosive coupler to primer 1.

Figure 3:
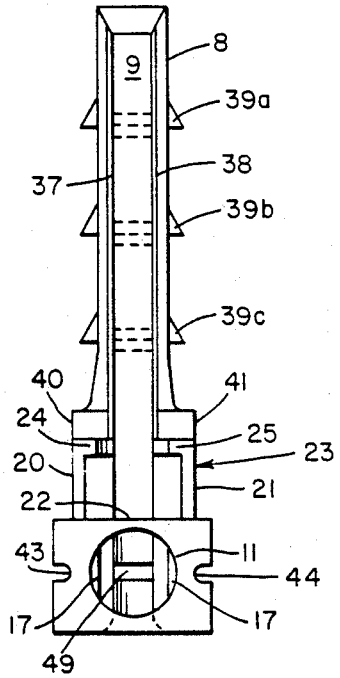
FIG. 3 is an end view of the connecting block shown in FIG. 2.

In this assembly, connecting block 7' is essentially the block 7 of FIGS. 1, 2, and 3 without arm 8 and without extension members 20 and 21. Grooves 43 and 44, and slot 45 are present, as are grooves in the end surface of arm 10 adjacent grooves 43 and 44 (one of these, 54, is seen in FIG. 4). An aperture 48, which is the portion of passageway 9 of the FIG. 1 block that is located in its arm 10, remains. This block, like arm 10 of the FIG. 1 block, houses explosive coupling elements 12. Block 7' of FIG. 4 has no detonator-engaging means and no block-attaching stem portion. In this assembly, detonator 19 is seated in cavity 4, and held in its required proximity to coupling charge 14 when block 7' is secured to jacket 2 in cavity 5 by the tongue and groove connection made with the mating ribs 47 in jacket 2 and the grooves in block 7'. Securing the block to the primer in this manner also affords a means of holding the LEDC in proper initiating relationship with respect to coupling charge 14 because of the presence of aperture 48 in block 7'.

Inasmuch as cavity 4 is longer than detonator 19, and the latter is not pre-engaged by the FIG. 4 connecting block, proper positioning of the detonator with respect to the explosive coupler requires a stop means for seating the detonator with the end surface **32*a* of shell 32 exposed so that it can abut block 7'. To accomplish this, the end of detonator shell 26 is flared out circumferentially to form a flange 26*b*, which stops the further entry of detonator 19 into cavity 4**.

Figure 5:
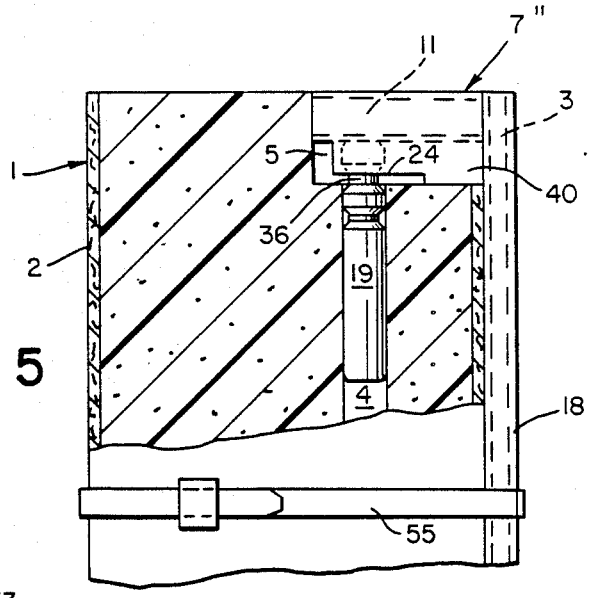
FIG. 5 is a partially cross-sectional view of a portion of a primer assembly of the invention wherein the primer's cord-threading aperture is an externally attached tubular member outside the primer body that forms an integral unit with the explosive coupler's connecting block.

In an alternative assembly of the invention, shown in FIG. 5, cord-threading aperture 3 is an open conduit in tubular member 18, located outside primer 1. Cavities 4 and 5 are present as in the FIG. 1 assembly, but, in this primer, cavity 5 extends through to the outer surface of wrap 2. Connecting block 7'' forms an integral unit with tubular member 18, and fits into cavity 5 with the wider portions 40 and 41 of extension members 20 and 21 abutting the opposing surface of primer 1 in cavity 5. Coupling element 12 is located in bore 11, with coupler shell 13 resting against stop means 17, as in FIG. 1, and the coined-bottom end **13*a* of shell 13 facing aperture 3 in tubular member 18 through an opening in the stop means and in wall of tubular member 8. Lips 24 and 25 on extension members 20 and 21, respectively, engage detonator 19 by gripping circumferential crimp 36. Block 7''' is seated in cavity 5 as shown, thereby positioning detonator 19 in cavity 4 and tubular member 18 alongside the primer wall. The assembly is held in place by closure of circumferential strap 55, which is suitably attached to tubular member 18**, e.g., by being molded therewith or passed through a slot therein.

Figure 6:
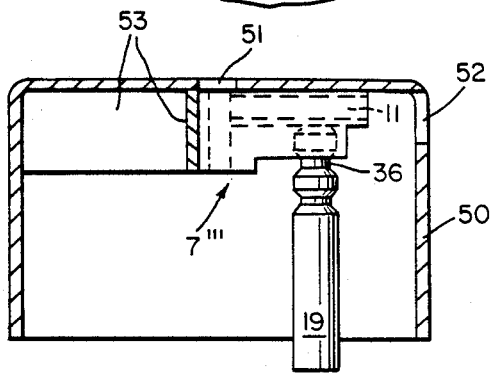
FIG. 6 is a partially cross-sectionalal view of an explosive coupler of the invention, whose connecting block forms an integral unit with an end-cap for the explosive primer.

In FIG. 6, 50 is a closure cap adapted to be placed over the end of an explosive primer and held there by interference fit. This closure cap can be used with any cylindrical primer having a detonator-receiving cavity 4 and a cord-receiving perforation 3 (as in FIG. 1). Block-receiving cavity 5 is not required. Closure cap 50, e.g., made of plastic, forms an integral unit with connecting block 7''', and its end portion is provided with a substantially central aperture 51, which is coaxial with aperture 48 in block 7''' and with the cord-receiving perforation 3 in the explosive primer onto which closure cap 50 is to be fitted. Bore 11 is adapted to receive coupling element 12 through an access opening 52 in the side wall of closure cap 50. When coupling element 12 is in position in bore 11, coupler shell 13 rests against stop means 17 (as in FIG. 1), and the coined-bottom-end **13*a* of shell 13 faces aperture 48 through an opening in the stop means (also as in FIG. 1). Support ribs 53 provide strength to the cover/coupler assembly when it is in place over the end of an explosive primer with detonator 19 in a cavity 4** therein.

Figure 7:
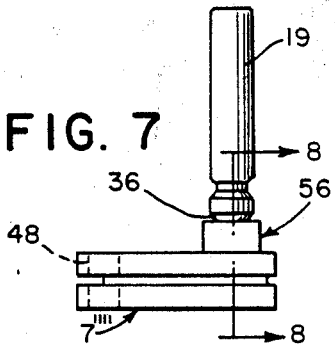
FIG. 7 is a side elevation of a coupler/detonator assembly of the invention adapted to be seated in the primer shown in FIG. 4.
Figure 8:
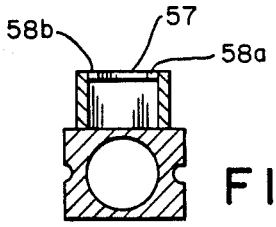
FIG. 8 is a sectional view taken along line 8—8 of FIG. 7.

The connecting block 7'' shown in FIGS. 7 and 8 is basically the connecting block 7' shown in FIG. 4 provided with a means for engaging and holding a detonator in position thereon. Detonator-engaging means 56 is essentially a box-like fitting having a central aperture 57 in its thin closed top, with a pair of diametric slits **58*a*,*b* emanating from the aperture. Detonator 19 is forced into fitting 56 through the yieldable aperture 57, which grips crimp 36 on the detonator. The coupler/detonator assembly is inserted into empty cavities 4 and 5 in the primer shown in FIG. 4** and locked in position by the tongue and groove connection.

The present primer assembly is adapted to be used in the priming of cap-insensitive explosives by the initiation impulse supplied by a low-energy detonating cord (LEDC) on which the primer assembly is strung together with other such assemblies at spaced intervals, e.g., in deck-loaded boreholes. The LEDC has a low enough explosive core loading, i.e., only up to about 2.0 grams per meter of cord length, that it does not directly initiate or disturb the explosive to be primed nor require heavy confinement or wide separation from the primer explosive or from the detonator in the primer to avoid initiating them directly, as is the case with heavier cords. At the same time, the side energy output of the detonating cord is sufficient to initiate the coupling explosive charge adjacent thereto. A preferred cord is one described in U.S. Pat. No. 4,232,606, the disclosure of which is incorporated herein by reference. This cord has a solid core of a deformable bonded detonating explosive composition comprising a crystalline high explosive compound, preferably superfine PETN, admixed with a binding agent. The crystalline explosive loading of this cord should be at least about 0.1 gram per meter, a preferred loading being in the range of about from 0.2 to 1.0 gram per meter. With explosive core loadings at the upper end of the LEDC range, e.g., about 2.0 grams per meter or higher, suitable confinement may be provided, e.g., a polyethylene sheath at least 0.16 cm thick around the core of explosive, to prevent direct initiation of the primer or the explosive charge to be primed. Suitable confinement also may be provided in the primer itself, e.g., as a lining tube in perforation 3 or passageway 9 in block arm 8. The cord described in U.S. Pat. No. 3,125,024 also can be used, e.g., in a granular PETN core loading of about 0.7 to 1.0 gram/meter. LEDC in which a granular explosive core is confined in a metal tube also can be employed (U.S. Pat. No. 2,982,210).

The means of threading LEDC through the primer assembly can be a perforation through the primer itself (as in FIGS. 1 and 4), or a conduit in a tubular body attached to the primer (as in FIG. 5) or in a plastic container for the primer. Because a large separation between the cord and the detonator is not required, the cord preferably is run through a perforation in the primer itself. Most preferably, the cord-receiving perforation lies substantially on the primer's longitudinal axis, as this produces a more balanced primer assembly to facilitate the sliding of multiple primers on a common LEDC downline in borehole loading.

In an alternative assembly, used to advantage when the LEDC has a lightly confined explosive core in a loading which is at the upper end of the LEDC range, the cord is run on the outside of the primer explosive body, e.g., through an external conduit in a plastic tube or container, or through multiple aligned external conduits or ferrules attached to a plastic container. This embodiment allows isolation of the cord from the primer explosive and maximum separation between the cord and detonator to prevent such occurrences as fragmentation of the primer explosive or damage to, or premature detonation of, the detonator.

The detonator-receiving cavity is a perforation in the primer that may extend completely, but usually extends only partly, therethrough. It runs substantially parallel to the primer's longitudinal axis, and to the longitudinal axis of the cord-receiving perforation or conduit. The spacing required between the detonator-receiving cavity and the cord-threading perforation or conduit depends on the side energy output of the cord and on the detonator structure, larger spacings being required with more energetic cords to prevent a given detonator from detonating directly from the side output of the cord with bypassing of the detonator's delay charge. With the preferred LEDC, i.e., the cord described in Example 1 of the aforementioned U.S. Pat. No. 4,232,606, having a PETN loading of 0.5 gram per meter in its core sheathed in 0.9-mm-thick polyethylene, it is preferred to have a spacing of at least 1.5 mm when the spacing is filled with primer explosive and the detonator's priming charge, usually lead azide, is housed in a standard detonator shell, e.g., 0.4-mm-thick Type 5052 aluminum alloy. With common primers of cast pentolite, the present primer assembly has given good performance with a cord/detonator separation of about 3.2 mm with the aforementioned 0.5 g/m cord. If the primer explosive, i.e., 1*a* in FIG. 1, is too hard for convenient gripping of a connecting block such as that shown in FIG. 1, a softer lining tube, e.g., tube 6 in FIG. 1, can be used around the cord perforation.

The detonator employed in the present assembly is a detonator adapted to be actuated by the percussive force applied thereto by the detonation of the coupling charge (14 in FIG. 1) arrayed substantially perpendicular thereto. End-actuated detonators such as those described in U.S. Pat. Nos. 4,429,632 and 3,709,149 may be used. These detonators are closed at their actuation end by a partially empty, tubular metal primer shell that supports a percussion-sensitive primer charge adjacent the inside surface of an integrally closed end. This closure can be, for example, an empty primed rim-fired or center-fired rifle cartridge casing.

The low-energy detonating cord and the percussion-actuated detonator are operatively joined in the present primer assembly by means of an explosive coupler in which a coupling charge of shock-sensitive detonating explosive is housed in linear array in a bore in a substantially tubular plastic connecting block that is attached to the primer (i.e., to the primer explosive or to an end-cap or container for the primer explosive) so that the coupling charge is substantially perpendicular to the detonator. The coupling charge is also perpendicular to the cord and is adapted to pick up the detonation from the cord, boost the energy level of the detonation, and apply sufficient percussive force in a radial direction as to selectively initiate the percussion-sensitive charge in the detonator. The bore in the connecting block may be completely closed, e.g., by a thin plastic membrane, to permit the coupling charge to be loaded directly into the bore and retained therein, the location of the closure and the attachment of the block to the primer being such that the closure faces LEDC threaded through the cord-threading aperture in the primer. In such a case the explosive-containing block is itself a coupling element. However, it is preferred that a self-contained coupling element, e.g., a sealed plastic or metal shell containing the coupling charge, be employed. Such an element is more readily adapted to production in commonly available loading equipment, and can be positioned in the connecting block to form the explosive coupler at the place of manufacture or in the field.

When the coupling charge is housed within a coupler shell that is integrally closed at one end and sealed at its opposite end with a plug, and the shell is to be seated within the bore in the connecting block, the bore is partially closed, e.g., narrowed or otherwise constricted as by projections or the like, or completely closed, as by a thin plastic membrane, so that the integrally closed end of the shell may rest against the resulting stop means, which will face the LEDC to be threaded through the cord-threading aperture in the primer to which the block is to be attached. As a result, the coupling charge in the bore or in the shell may be positioned in close enough proximity to the LEDC as to be initiatable by the cord's detonation.

In the primer assembly of the invention, the percussion-actuated detonator is seated in a cavity in the primer and held at a location therein required to place the coupling explosive charge in the connecting block in initiating proximity to the detonator's percussion-sensitive ignition charge. This preferably is accomplished by use of the explosive coupler of the invention wherein the connecting block contains detonator-engaging means adapted to engage the detonator so that the required positioning can be accomplished by an interlocking or mating of elements or surfaces on the block and on the detonator. One such coupler is shown in FIGS. 1, 2, and 3, in which a channel member on the block engages a circumferential crimp on the detonator shell. This particular channel member provides for slidability of the detonator so that the coupler can be used with primers having different spacings between the detonator cavity and the cord perforation or conduit. However, the detonator may be engaged at a fixed location on the block, if desired, e.g., as is shown in FIGS. 7 and 8. Factory- or field-assembly of the coupler/detonator unit may be used.

Alternative methods of holding the detonator at the required location in the cavity include contouring the cavity itself, or flanging the end of the detonator shell circumferentially, as is shown in FIG. 4, so that the percussion-actuated end cannot recede too far into the detonator-receiving cavity and thereby prevent proper contact with the explosive coupler. If desired, a fitting may be placed over the end of the detonator and suitably configured to position the detonator in cavity 4 as required. With these alternative methods, the coupling charge will become positioned in required proximity to the detonator's percussion-sensitive ignition charge in the primer's cavity when the coupler is attached to the primer.

Preferred means of attaching the explosive coupler to the primer are shown in FIGS. 1 through 6. One preferred means is provided by the connecting block of the invention (shown in FIGS. 1, 2, and 3), which is a substantially L-shaped member having first and second perpendicular arms of substantially tubular configuration One arm of the L is the portion of the block that houses the coupling charge, and the other is the block-attaching means. The block-attaching arm or stem has an open passageway adapted to have a low-energy detonating cord threaded therethrough, and preferably has gripping means, such as teeth, on its external surface adapted to grip the wall of the cord-threading aperture in or associated with the explosive primer. The detonator-engaging means on the charge-housing arm positions the detonator parallel to the block-attaching arm. When the latter is inserted into the cord-threading aperture, the engaged detonator takes its position in the detonator-receiving cavity, and the LEDC can be threaded through the aperture via the open passageway in the block arm. This block serves several functions. In addition to containing and protecting the coupling explosive charge, it is adapted to hold the coupling charge in its required position with respect to both the LEDC and the detonator when the detonator is in the cavity in the primer and the cord is threaded through the primer's cord-receiving perforation or associated conduit.

The connecting block is constructed from a thermoplastic or thermosetting plastic material. To protect the coupling charge from accidental detonation by impact if the primer assembly should inadvertently be dropped through large distances, e.g., 30 meters or more, in a borehole, the plastic thickness of the block around the coupling charge should be at least about 1.5 mm.

With explosive couplers which house the coupling charge in a special coupling element, as previously described, it may be preferred in some instances to have the coupling element communicate with the passageway in the cord-attaching arm in the connecting block of the invention through an opening in the stop means for the coupling element. Thus the coupling element is pushed into the bore until it comes to rest against the stop means, and the integrally closed end of the coupling element's shell is exposed to the cord in the passageway through the opening, thereby assuring good pickup of the detonation from the cord. If, for reasons to be explained later, the linear coupling explosive charge does not span the inner diameter of the charge-housing shell throughout its length, the charge preferably does so at the integrally closed shell end, where the charge picks up the detonation from the cord.

In a preferred connecting block and coupler, the means by which the coupling arm is adapted to engage the detonator may be a cup-shaped or box-like fitting, a substantially U-shaped channel, or the like in which the detonator is adapted to be gripped either to be held in one position or to be slidable parallel to the coupling arm's axis and restricted in motion normal thereto. For example, a pair of lips along the channel edges, or a constricted opening in a box-like fitting (as in FIGS. 7 and 8), which grip a circumferential crimp at the detonator's actuation end may be used. In some primer assemblies, the detonator may be provided with means of attachment to the block's coupler arm, e.g., an extension sleeve over the actuation end having a diametric loop or bail which may be slipped around the coupler arm or around suitably configured fingers or arm members on the coupler.

The explosive coupler contains a coupling charge of shock-sensitive detonating explosiv linearly arrayed in the bore of the connecting block's coupling arm, preferably in the form of a self-contained coupling element seated therein. A preferred coupling element is a sealed, explosive-containing plastic or metal shell, e.g., the metal shell shown in FIG. 1. The coupling explosive must be sufficiently shock-sensitive, and be present in sufficient quantity, that it will be initiated reliably from the side energy output of the LEDC adjacent thereto, e.g., adjacent the integrally closed end of a metal shell in the coupling element. Moreover, the coupling charge, upon detonation, must apply sufficient percussive force in a radial direction as to selectively initiate the percussion-sensitive charge in the detonator. Granular explosives such as dextrinated lead azide and lead styphnate are preferred coupling charges because of their high degree of sensitivity to shock, and their good flow properties. The use of explosive mixtures such as a 1.5/88.5/10 mixture, by weight, of boron/red lead/dextrinated lead azide, and others mentioned in U.S. Pat. No. 3,306,201, also is feasible.

The size of the coupling charge preferably should be as small as possible so that the energy output from the explosive coupler will selectively initiate the percussion-sensitive charge in the detonator, i.e., that it will not initiate the explosive charge surrounding the primer assembly, or the primer itself, or cause the detonator to separate from the primer. The minimum amount needed will depend on such variables as the strength of the coupling explosive (dependent somewhat on its degree of compaction and purity), the nature of any inert spacer used in the coupling element's shell (e.g., lining tube 15 in FIG. 1), and the spacing between the coupling charge and the percussion-sensitive charge in the detonator, and the nature of inert material(s) therebetween. A smaller coupling charge can be used with a thinner-walled coupler shell and connecting block.

When, as in the preferred case, the coupling charge is contained in a thin-walled metal shell seated in the coupling arm of the plastic connecting block, an unpressed explosive powder will be used in small diameter, e.g., less than 2.5 mm, to produce the desired small-size linear coupling charge. Therefore, a shell with less than a 2.5 mm inner diameter would be required if the explosive were to span the diameter of the shell. Inasmuch as shells having such small inner diameters are difficult to fabricate and fill, especially with automatic equipment, it is preferred to provide an inert spacing means inside a standard shell to form the small diameter. At the end of the shell which is to be positioned adjacent the LEDC, the coupling charge preferably spans the shell diameter, however, to allow as large a surface as possible to the exposed to the side output energy of the LEDC. A preferred spacing means is a lining tube (suitably of a thermoplastic material such as nylon) which has a bore diameter equal to the selected coupling charge diameter and which ends short of the shell's integrally closed end (e.g., 15 in FIG. 1) to create a space between the spacer tube and the bottom of the shell. When the shell is loaded with explosive powder, the powder fills this space and the bore in the spacer tube. Bevelling or tapering of the edges of the tube inward toward its bore is desirable as this facilitates the loading of powder into the free space and the small-diameter bore. With 25-mm-long metal coupler shells having a wall thickness of 0.5 mm and containing a 19-mm-long, 6.4-mm outer diameter plastic spacer tube such as that shown in FIG. 1, it is preferred to have a bore diameter in the spacer tube of about from 1.8 to 2.8 mm, with a diameter of about 2.2 mm being most preferred. This results in a preferred explosive (lead azide) loading of about from 0.1 to 0.2 gram, with about 0.15 gram being most preferred. With a 36-mm-long aluminum spacer tube, a bore diameter of about 3.0 mm and an explosive loading of about 0.65 gram may be used owing to the heavier confinement afforded by the metal spacer. As a rule, the explosive loading of a linear charge such as that shown in FIG. 1 should be in the range of about from 1.2 to 23, and preferably about from 5.8 to 14, grams per meter of charge length. For any given set of conditions related to the nature and thickness of the material(s) between the coupling explosive and the percussion-sensitive charge in the detonator (e.g., the wall of the coupler shell, internal spacer tube, if used, and coupler arm of the plastic connecting block), it would be advantageous to select an explosive loading which is not at or near the minimum specified if adverse field conditions may be expected, e.g., the entry of sand into an air space between the block arm and the detonator end, which might lead to failure if the coupling explosive load is marginal. On the other hand, if there is the possibility of the entrance of water into this space, loads at or near the maximum may cause the empty primed rifle cartridge casing of the detonator's ignition assembly to be punctured and the detonator to fail.

The above discussion relates to a linear coupling charge in which the explosive charge is continuous. The term "a coupling charge linearly arrayed" as used herein, however, also denotes a charge in which the linear array is formed from layers of explosive separated by an inert spacer, with small paths of communication between the explosive layers provided, for example, by a loose fit between the spacer and the inner wall of the shell, a small axial hole through the spacer, or grooves along the outer surface of the spacer. The communication paths are sufficiently narrow that powder cannot sieve through out of one of the explosive layers. In this embodiment, the layers of explosive span the diameter of the shell, with a layer of explosive adjacent the integrally closed end of the shell (for pick-up of the detonation from the adjacent LEDC), and a layer on the longitudinal axis of the detonator adjacent the latter's percussion-actuated end. In this embodiment, the explosive loading of each explosive layer in a 0.6-cm inner diameter metal shell should be 0.02 0.13 gram, 0.06 gram being preferred.

After the coupler shell, optionally containing a spacer lining tube, has been loaded with explosive, or with explosive/spacer/explosive layers as described above, the shell is sealed, e.g., with a solid plastic sphere slightly larger in diameter than the inside of the shell, a tight fit being thereby obtainable owing to the slight deformation of the sphere as it is pushed into the open end of the thin-walled metal shell. For example, a 6.9-mm-diameter polyethylene sphere has been found to seal a 6.5-mm internal diameter aluminum shell against a hydrostatic head over 150 meters deep.

The overall length of the linearly arrayed coupling charge, and therefore of a shell used to contain it, is sufficient to span the distance between the aperture of the LEDC-threading means (e.g., cord-receiving perforation 3 in primer 1 in FIG. 1) and the detonator-receiving cavity. Preferably, the charge is long enough to span across the entire diameter of the cavity so that the entire surface adjacent the percussion-sensitive primer charge in a center- or rim-fired empty primed rifle cartridge casing, for example, will have the coupling charge next to it. However, partial spanning of the cavity's diameter would be acceptable if the energy output of the coupling element were high.

To assure reliable initiation of the coupling charge, the spacing between this charge and the explosive core of the LEDC should be as small as possible. The distance between the LEDC described in the aforementioned U.S. Pat. No. 4,232,606 and the bottom of the shell in the coupling element should not exceed 3.2 mm. Preferably, there is a spacing of about from 0.25 to 0.75 mm between the cord and the shell bottom. This is sufficient to allow free cord movement but is small enough to prevent the accumulation of foreign material and assure initiation reliability. Preferred coupler shells are coined-bottom aluminum shells having a bottom thickness of about 0.13 mm. If the cord described in U.S. Pat. No. 4,232,606 is positioned within 1.6 mm of the shell bottom, aluminum shells having a bottom thickness of up to 0.5 mm, and bronze shells having a bottom thickness of up to 0.25 mm, can be used. Inasmuch as a stop means is required in the bore of the coupler arm of the connecting block to provide the proper positioning of the coupling element therein, it is preferred that the stop means be so designed as to allow at least a portion of the coined bottom of the shell to be exposed directly to the energy emitted radially from the adjacent cord when it detonates. An exposure diametrically across the shell bottom of about 2.0 mm or more wide and 7.3 mm long may be used.

The distance between the coupling explosive charge and the outside end surface of the percussion primer in the detonator also is kept to a minimum to assure reliability. The connecting block preferably is made from a moldable thermoplastic such as high- or low-density polyethylene, polypropylene, nylon, or polystyrene, and the thickness of the block's coupler arm in the region between the coupling element and the detonator preferably is less than about 3.2 mm. Polyethylene having a wall thickness in the specified region of 0.4 to 2.5 mm is most preferred. If the coupling charge is in a special coupler shell seated in the connecting block, the wall of the plastic block between this shell and the detonator can be cut out. With the plastic spacer tubes that generally will be used with metal coupler shells to achieve the desirably low loadings of the coupling explosive charge, the coupler shell should have a sidewall thickness no greater than about 1.0 mm. In addition to the walls of the plastic spacer tube (optional), metal coupler shell (optional), and connecting block arm present between the coupling charge and the detonator, a small clearance may be present between the block and the detonator. This is useful when the conection of the detonator to the block is to be made in the field. With reference to the assembly shown in FIG. 1, for example, the detonator can, to a limited extent, move axially owing to the difference between the thickness of lips 24 and 25 and the width of crimp 36. This axial mobility of the detonator should be controlled so that an air space no wider than about 1.6 mm results. Because, in use, a free air space may become filled with water, sand, surrounding explosive, etc., and this may overly confine, or overly magnify, the energy output of the coupling element, the air space should be kept to a minimum.

The following example is illustrative of a delay primer assembly as shown in FIG. 1, and the functioning thereof.

(a) Primer 1 was the cast primer described in Example 1 of U.S. Pat. No. 4,343,663, with the following modifications: A cavity (5 in FIG. 1) was present adjacent the cord tunnel and cap well as shown in FIG. 1 herein, cavity 5 being conformed to receive and hold a portion of a connecting block of the invention, to be described below. Also, booster 4 in the cast primer of U.S. Pat. No. 4,343,663 (tube 6 in FIG. 1 herein) was 10.8-cm long in the present assembly, and extended to cavity 5, also as shown in FIG. 1 herein.

(b) Connecting block 7 was made of high-density polyethylene. Arms 8 and 10 were 5.3 cm and 2.9 cm long, respectively, inclusive of their overlapping portions. Bore 11 in arm 10 was 2.5 cm long and 0.70 cm in diameter. Extension members 20 and 21 were 2.2 cm long and 0.52 cm wide, the portions thereof forming walls 40 and 41 being 2.4 mm wider. Surface 22 between extension members 20 and 21 was 7.7 mm wide. The inner diameter of arm 8, i.e., the diameter of passageway 9 in the portion thereof adjacent bore 11 of arm 10, was 3.6 mm.

(c) Coupling element 12 consisted of a 25-mm-long aluminum shell having a 6.5-mm inner diameter, a 7.3-mm outer diameter, and a coined integrally closed end, the thinned portion of the coined end being 0.13-mm thick and 4.6 mm in diameter. The plastic lining tube 15 was made of nylon, was 19 mm long, and had a 6.5-mm outer, and a 2-mm inner, diameter. The ends of the lining tube tapered inward 15°. It was pushed to the bottom of the shell and fitted snugly therein. Dextrinated lead azide in the amount of 0.16 gram was loaded into the lined shell, filling the space between the tapered end of the lining tube and the bottom of the shell, as well as the bore of the tube (verifiable by X-rays). A 6.9-mm-diameter solid polyethylene sphere was used to seal the shell and press the lead azide. Excess lead azide formed a layer beneath the sealing sphere, but this is not required to actuate the detonator. Coupling element 12 was seated in bore 11 abutting against the stop means 17 therein, thereby exposing the end of shell 13 to passageway 9.

(d) Detonator 19 was the detonator described in Example 1 of U.S. Pat. No. 4,429,632. The length of the delay charge was sufficient to provide a 100-ms delay. The thickness of the wall of coupler arm 10 between shell 13 and end **32*a* of primer shell 32 in the detonator was 0.6 mm, and the maximum air space between end 32*a* and coupler arm 10** due to the axial mobility of the detonator was 0.3 mm.

With coupling element 12 in position in bore 11, and detonator 19 engaged by channel 23, connecting block 7 was placed in cavity 5 of primer 1 with arm 8 engaging the inside wall of small booster 6 and detonator 19 in cavity 4. Walls 40 and 41 and end surface 42 abutted the cavity wall of primer 1, leaving a 1.6-mm spacing between lips 24 and 25 and the cavity wall. A length of the LEDC described in Example 1 of U.S. Pat. No. 4,232,606 was threaded through perforation 3 and passageway 9 as shown. The LEDC was detonated by means of a No. 6 electric blasting cap having its end in coaxial abutment with an exposed end of the cord.

Fifteen of the above-described assemblies were made. All fifteen primers detonated after the proper delay times, indicating that the coupling charge had picked up the detonation from the LEDC, transmitted it exclusively to the percussion primer in the delay detonator, which initiated primer 1.

Similar results were obtained when the connecting block assembly was inserted into 0.45-kg primers of cast pentolite, the primers in this case having no cavity to allow recessing of the block completely within the confines of the primers. In these primer assemblies, walls 40 and 41 and end surface 42 abutted the end of the cylindrical primer leaving the coupler arm and actuation end of the detonator outside the confines of the primer. With such primers, an extension cover member may be applied to the primer to form a protective enclosure for the protruding portion of the connecting block.

The cast primers in the above assemblies were made as described in U.S. Pat. No. 4,343,663, the disclosure of which is incorporated herein by reference. Briefly, the primer explosive was cast into a cardboard tube which was seated on a preformed base plate to which two metal pins were affixed (to produce perforation 3 and cavities 4 and 5). Tubular booster 6 was positioned on the axial pin. In an alternative embodiment, tubular booster 6 may be replaced by a small packaged charge of a cap-sensitive explosive such as PETN, tied or otherwise affixed to the axial pin, or the offset pin, and the primer explosive cast around it.

I claim:

1. An explosive coupler for operatively joining a low-energy detonating cord (LEDC) to a percussion-actuated detonator comprising:

(a) a plastic connecting block housing a coupling charge of shock-sensitive detonating explosive in linear array in a bore therein, said bore being completely spanned by a thin closure membrane so as to adapt it to retain said linear coupling charge; and (b) detonator-engaging means on said block adapted to engage a detonator having a percussion-sensitive ignition charge therein at its actuation end in a manner such that said coupling charge is perpendicular to said detonator and held in initiating proximity to said detonator's percussion-sensitive ignition charge.

2. An explosive coupler of claim 1 wherein said block contains a cord-receiving aperture lying on a longitudinal axis which is perpendicular to the longitudinal axis of said explosive-containing bore, and parallel to the detonator which said block is adapted to engage, said aperture in said block being adjacent said thin membrane so that LEDC threaded through said aperture is directed to pass in close enough proximity to said coupling charge as to initiate it.

3. An explosive coupler of claim 2 wherein said shock-sensitive detonating explosive is lead azide powder.

4. An assembly for the delay initiation of an explosive primer by means of a low-energy detonating cord comprising (a) an explosive coupler comprising a plastic connecting block housing a coupling charge of shock-sensitive detonating explosive in linear array in a bore therein, and, (b) in engagement with said block, a delay detonator having a percussion-sensitive ignition charge therein at its actuation end, said coupling charge being perpendicular to said detonator and held in initiating proximity to said detonator's percussion-sensitive ignition charge.

5. An assembly of claim 4 wherein said detonator-engaging means is a thin-walled tubular fitting which holds said detonator by interference fit.

6. An assembly of claim 4 wherein said detonator-engaging means is a box-like member having a yieldable aperture which grips a circumferential closure crimp in said detonator's shell.

7. An assembly of claim 4 wherein said block is in engagement with a circumferential crimp on the outer shell of said detonator.

8. An assembly of claim 7 wherein the engagement between said block and said crimp is made via a channel member on said block.

9. An assembly of claim 8 wherein said channel member engages said crimp in a slidable manner.

10. A connecting block for explosively coupling low-energy detonating cord (LEDC) to a percussion-actuated detonator comprising a substantially L-shaped plastic member having first and second perpendicular arms of substantially tubular configuration, said first arm having an open passageway adapted to have LEDC threaded therethrough, and said second arm having a bore adapted to receive a linearly array a coupling charge of shock-sensitive detonating explosive, and to retain said charge adjacent the passageway in said first arm through which the LEDC is to be threaded, said second arm being adapted to engage a percussion-actuated detonator in a manner such that (a) said detonator is positioned substantially parallel to said first arm and substantially perpendicular to the bore in said second arm, and (b) said detonator's percussion-sensitive ignition charge is held in initiatable proximity with respect to the coupling charge adapted to be linearly arrayed in said bore.

11. A connecting block of claim 10 wherein said first arm has gripping means on its external surface adapted to engage the wall of a cord-threading aperture in or associated with a substantially cylindrical explosive primer when said first arm is inserted therein.

12. A connecting block of claim 11 wherein stop means projects into the bore in said second arm adjacent said open passageway, said stop means being adapted to position a sealed, explosive-containing shell adjacent said open passageway.

13. A connecting block of claim 12 wherein said stop means has an open structure which allows direct communication between said bore and said passageway, whereby a portion of the end of a shell to be positioned in said bore is adapted to be exposed to said passageway.

14. A connecting block of claim 12 wherein said second arm is provided with a channel member adapted to slidably engage said detonator.

15. A connecting block of claim 14 wherein said channel member is substantially U-shaped in cross-section with the sides of the U turned inward at their ends whereby they are adapted to grip a circumferential closure crimp in a detonator shell at the detonator's actuation end.

16. An explosive primer comprising a substantially cylindrical mass of explosive having (a) a cord-receiving perforation and a detonator-receiving cavity substantially on or parallel to its longitudinal axis, said perforation and cavity being spaced apart from one another, and said perforation extending substantially from one end of said cylindrical mass to the other; and (b) a block-like cavity for receiving a connecting block adjacent said cord-receiving perforation and said detonator-receiving cavity.

17. An explosive primer of claim 16 having an outer plastic jacket containing holes in the block-like cavity portion thereof to allow access to said cord-receiving perforation and said detonator-receiving cavity, said cavity portion of said jacket being provided with means for attaching an explosive coupler connecting block thereto.

18. An explosive primer of claim 17 wherein said block-attaching means is a linear rib.

19. An explosive coupler for operatively joining a low-energy detonating cord (LEDC) to a percussion-actuated detonator comprising:

(a) a plastic connecting block housing a coupling charge of shock-sensitive detonating explosive in linear array in a bore therein, said bore being at least partially closed by stop means adapted to position a housing shell for said coupling charge at a desired location; and (b) a detonator-engaging means on said block adapted to engage a detonator having a percussion-sensitive ignition charge therein at its actuation end in a manner such that said coupling charge is perpendicular to said detonator and held in initiating proximity to said detonator's percussion-sensitive ignition charge.

20. An explosive coupler of claim 19 integrally attached to a plastic tubular member adapted to receive a low-energy detonating cord perpendicular to the linear coupling charge, said tubular member being provided with means of attachment to an explosive primer to hold said tubular member longitudinally outside the primer wall.

21. An explosive coupler of claim 19 integrally attached to an end closure cap adapted to fit over the end of an explosive primer.

22. An explosive coupler of claim 21 wherein said shock-sensitive detonating explosive is lead azide powder.

23. An explosive coupler of claim 19 wherein said block contains a cord-receiving aperture lying on a longitudinal axis which is perpendicular to the longitudinal axis of said explosive-containing bore, and parallel to the detonator which said block is adapted to engage, said aperture in said block being adjacent said block's stop means so that LEDC threaded through said aperture is directed to pass in close enough proximity to said coupling charge as to initiate it.

24. An explosive coupler of claim 23 wherein said connecting block has peripheral grooves adapted to mate with ribs formed in the surface of a block-like cavity adapted to accommodate said block.

25. An explosive coupler of claim 23 wherein said connecting block is a substantially L-shaped member having first and second perpendicular arms of substantially tubular configuration, said first arm having an open passageway adapted to have a low-energy detonating cord threaded therethrough, said cord-threading aperture in said block constituting a part of said open passageway, and said second arm housing said coupling charge in a bore therein.

26. An explosive coupler of claim 25 wherein the first arm of said L-shaped block is substantially tubular and is provided with gripping means on its external surface.

27. An explosive coupler of claim 23 wherein said detonator-engaging means is a channel member adapted to slidably engage said detonator whereby the distance between said detonator and the cord-threading aperture in said block can be varied.

28. An explosive coupler of claim 27 wherein said channel member is substantially U-shaped in cross-section with the sides of the U turned inward at their ends whereby they are adapted to grip a circumferential closure crimp in a detonator shell at the detonator's actuation end.

29. An explosive coupler of claim 23 wherein said coupling charge is housed in a self-contained coupling element comprising a metal shell having an integrally closed end, and its opposite end closed with a plug, the integrally closed end of said shell resting against said stop means in the bore of said connecting block adjacent said cord-threading aperture.

30. An explosive coupler of claim 29 wherein said stop means has an open structure which allows direct communication between said metal shell and said cord-threading aperture.

31. An explosive coupler of claim 29 wherein said metal shell contains a plastic lining tube ending short of the shell's integrally closed end, said coupling charge being located in the bore of said lining tube and in the space adjacent the shell's integrally closed end.

32. An explosive coupler of claim 23 wherein said detonator-engaging means is a yieldable fitting which accepts and holds said detonator in fixed position relative to said cord-threading aperture.

33. An explosive coupler of claim 32 wherein said fitting is a box-like member having a yieldable aperture adapted to grip a circumferential closure crimp in a detonator shell.

34. An explosive coupler of claim 32 wherein said fitting is a thin-walled tube adapted to hold a detonator by interference fit.

* * * * *